US011717135B1

(12) United States Patent
Wood

(10) Patent No.: US 11,717,135 B1
(45) Date of Patent: Aug. 8, 2023

(54) FOLDABLE KITCHENWARE DRYING RACK

(71) Applicant: Zak Wood, Sammamish, WA (US)

(72) Inventor: Zak Wood, Sammamish, WA (US)

( * ) Notice: Subject to any disclaimer, the term of this patent is extended or adjusted under 35 U.S.C. 154(b) by 0 days.

(21) Appl. No.: 17/890,690

(22) Filed: Aug. 18, 2022

(51) Int. Cl.
*A47L 19/04* (2006.01)
*A47L 19/00* (2006.01)

(52) U.S. Cl.
CPC ..... *A47L 19/04* (2013.01); *A47L 19/00* (2013.01)

(58) Field of Classification Search
CPC ..... A47L 19/00; A47L 19/02; A47L 19/04
See application file for complete search history.

(56) References Cited

U.S. PATENT DOCUMENTS 53,055 A * 3/1866 Stone et al. ..... D06F 57/08 211/198
222,542 A * 12/1879 Stearns ..... D06F 57/08 211/41.6
253,461 A * 2/1882 Wold ..... A47L 19/04 211/49.1
946,977 A * 1/1910 Muller ..... A47L 19/04 294/142
1,835,232 A * 12/1931 Lord ..... A47L 19/02 211/41.6
1,971,523 A * 8/1934 Feingold ..... A47L 19/04 211/41.5
2,479,118 A * 8/1949 Jenness ..... A47L 19/04 211/195
2,516,088 A * 7/1950 Einhorn ..... A47L 19/04 D32/55
2,958,424 A * 11/1960 Aldo ..... A47L 19/00 211/104
D252,251 S 7/1979 Lundahl
4,169,638 A * 10/1979 Cirasuolo ..... A47L 19/04 211/41.6
4,212,400 A * 7/1980 Buchsteiner ..... A47L 19/04 211/41.6
4,221,299 A * 9/1980 Taylor ..... A47L 19/04 211/41.6
D259,537 S * 6/1981 Taylor ..... D32/55
4,328,899 A * 5/1982 Krusche ..... A47L 19/04 D6/683
D271,339 S * 11/1983 Lee ..... D32/55
D322,343 S 12/1991 Pearcy
D342,343 S 12/1993 Slivko
D369,002 S 4/1996 Pratt
6,038,784 A * 3/2000 Dunn ..... F26B 25/18 211/41.6
D423,160 S * 4/2000 Lenney ..... D32/55
(Continued)

FOREIGN PATENT DOCUMENTS

GB 190920204 A * 9/1910
GB 174267 A * 1/1922
(Continued)

*Primary Examiner* — Stanton L Krycinski

(57) ABSTRACT

A foldable kitchenware drying rack has a base section, a primary support section with pivoting rear legs pivotally connected to the base section, a secondary support section pivotally connected to pivoting rear legs, and pivoting front legs pivotally connected to the base section. The pivoting rear legs are locked in an unfolded condition by removable rear leg lock members, and the pivoting front legs are stably supported by a front cross member of the base section in an unfolded condition.

20 Claims, 6 Drawing Sheets

(56) References Cited

U.S. PATENT DOCUMENTS

D429,863 S * 8/2000 Lenney ..... D32/55
6,170,676 B1 * 1/2001 Patadia ..... A47L 19/04 211/41.6
D449,414 S 10/2001 James et al.
6,357,605 B1 * 3/2002 Martorella ..... A47L 19/04 211/41.6
D465,891 S 11/2002 Brown
6,502,704 B2 * 1/2003 Martorella ..... A47L 19/04 211/41.6
D532,948 S 11/2006 Gillisie
7,228,975 B2 * 6/2007 Yang ..... A47L 19/04 211/41.4
7,455,184 B2 * 11/2008 Yang ..... A47L 19/04 211/41.6
7,475,785 B1 * 1/2009 Kidd ..... A47L 19/02 211/85.15
7,578,401 B2 * 8/2009 Schnitzer ..... A47L 19/04 211/41.6
7,735,661 B1 * 6/2010 Sumner ..... A47L 19/04 211/41.3
D634,909 S 3/2011 Guthrie
D690,483 S 9/2013 Renz et al.
8,573,410 B2 * 11/2013 Chalifoux ..... A47L 19/02 211/41.5
D706,009 S 5/2014 Cooper
D714,509 S 9/2014 Elodie
8,925,742 B1 * 1/2015 Chitayat ..... A47L 19/04 211/41.6
8,925,743 B1 * 1/2015 Lee ..... A47L 19/04 211/41.6
8,960,452 B2 * 2/2015 Rhodes, II ..... A47L 19/04 211/41.6
D732,256 S * 6/2015 Huang ..... D32/55
9,107,552 B2 * 8/2015 Micek ..... A47L 19/04
9,301,671 B2 * 4/2016 Jari ..... A47B 81/04
9,730,571 B1 * 8/2017 Lee ..... A47L 19/04
10,362,867 B2 * 7/2019 Williams ..... A47F 5/13
D858,021 S 8/2019 Li
10,631,711 B2 * 4/2020 Dunn ..... A47L 19/02
10,674,890 B1 * 6/2020 Armstrong ..... A47L 19/04
D896,458 S 9/2020 Han
D921,317 S 1/2021 Wood
11,103,121 B1 8/2021 Wood
D955,076 S * 6/2022 Wood ..... D32/55
2005/0145583 A1 * 7/2005 Martorella ..... A47L 19/04 211/41.6
2008/0149644 A1 * 6/2008 Piacenza ..... A47L 19/04 220/571
2008/0283480 A1 * 11/2008 Segall ..... A47L 19/04 211/41.6
2014/0366263 A1 * 12/2014 Thompson ..... A47L 19/04 4/654

FOREIGN PATENT DOCUMENTS

GB 256694 A * 8/1926
GB 436097 A * 10/1935
GB 627197 A * 8/1949
GB 2042147 A * 9/1980 ..... A47L 19/04

* cited by examiner

FOLDABLE KITCHENWARE DRYING RACK

RELATED APPLICATIONS

This is the first application filed for this invention.

FIELD OF THE INVENTION

This invention relates in general to racks for drying bottles and associated items, and, in particular to a novel foldable kitchenware dying rack.

FIELD OF THE INVENTION

Racks for drying bottles and other items that should be hand-washed such as plastic bags, silicone bags, vacuum insulated stainless steel cups and tumblers, certain plastic cups and bottles, and other kitchenware, are well known and commercially available in a variety of shapes, sizes and configurations. Most commercially available kitchenware drying racks are made of plastic or metal. Although plastic is convenient in the short term, it deteriorates over time and the production as well as the disposal of the used article are costly for the environment. Metal racks generally last longer and are more easily recycled, however the production of metal racks is costly for the environment and metal racks can rust and/or scratch bottles made of plastic materials. Consequently, applicant invented a foldable bottle drying rack described in United States Design patent D921317 S1, which is made of a sustainable material. That bottle drying rack has enjoyed considerable commercial success. However, after extensive use some shortcomings have been reported.

There therefore exists a need for a kitchenware drying rack made of a sustainable material that overcomes the disadvantages of the prior art.

SUMMARY OF THE INVENTION

It is an object of the invention to provide a kitchenware drying rack made of a sustainable material that is foldable for easy storage when not in use and overcomes the disadvantages of the prior art.

The invention therefore provides a foldable kitchenware drying rack comprising: a substantially rectangular base section having base side members, at least two base cross members and a plurality of base slats connected to the respective base cross members; first and second pivoting front leg members affixed by front leg pivots to an inner side of each base side member at a location spaced from a front end of the respective base side members; first and second pivoting rear leg members affixed to an inner side of the base side members at a location near a rear end of each base side member; at least two primary cross members connected on opposed ends to the first and second pivoting rear leg members; primary support posts connected to the respective secondary cross members in a spaced-apart relationship in parallel with the first and second pivoting rear leg members; first and second secondary side members pivotally connected on a bottom end to and inner side of the respective pivoting rear leg members; at least two secondary cross members connected on opposed ends to the respective first and second secondary side members; secondary support posts affixed to the respective secondary cross members in parallel with the first and second secondary side members; and lock members for locking the first and second pivoting rear leg members in an unfolded condition.

The invention further provides a foldable kitchenware drying rack comprising: a base section having first and second parallel base side members affixed to at least two base cross members and a plurality of identical base slats in a spaced-apart parallel relation between the base side members and affixed to the base cross members; a primary support section having first and second parallel pivoting rear leg members, each pivoting rear leg member pivotally connected above a bottom end to one of the first and second base side members behind a rear one of the base cross members, at least two primary cross members respectively connected on opposed ends to the first and the second pivoting rear leg members, and a plurality of primary support posts affixed to the primary cross members between the pivoting leg members and parallel therewith; a secondary support section having first and second secondary side members, each secondary side member being connected on a bottom end to an inner surface above the bottom end of one of the first and second pivoting leg members, and at least two secondary cross members having opposed ends respectively connected to the secondary side members, and a plurality of secondary support posts affixed to the first and second secondary cross members in parallel with the first and second secondary side members; and rear leg lock members that lock the pivoting rear legs in an unfolded condition.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a foldable kitchenware drying rack made of a sustainable material. The kitchenware drying rack folds flat for easy storage. The kitchenware drying rack has a base section with pivoting legs that elevate the base section from a supporting surface for improved air circulation to inhibit the development of mold, etc. The kitchenware drying rack further includes rear leg lock members that lock a primary and secondary support section of the rack in an unfolded condition to ensure that the rack cannot shift from the unfolded condition regardless of a bearing load on one or both of those support sections. In one embodiment, all parts of the kitchenware drying rack are glued laminations of at least two separate layers of bamboo or wood bonded together for dimensional stability.

| Parts List | |
|---|---|
| 10 | Kitchenware drying rack |
| 12 | Base section |
| 14 | Primary support section |
| 16 | Secondary support section |
| 18a-b | Base side members |
| 20a-b | Base cross members |
| 21 | Base slats |
| 22a-b | Pivoting front leg members |
| 24a-b | Front leg foot members |
| 26a-b | Pivoting rear leg members |
| 28a-b | Rear leg foot members |
| 30a-b | Primary cross members |
| 32 | Primary support posts |
| 34 | Primary support reinforcement member |
| 36a-b | Secondary side members |
| 38a-b | Secondary cross members |
| 40 | Secondary support posts |
| 42a-b | Front leg pivots |
| 44a-b | Primary/secondary section pivots |
| 46a-b | Rear leg lock members |
| 48 | Elastomeric feet |
| 50a-b | Rear leg lock rabbets |

Figure 1:
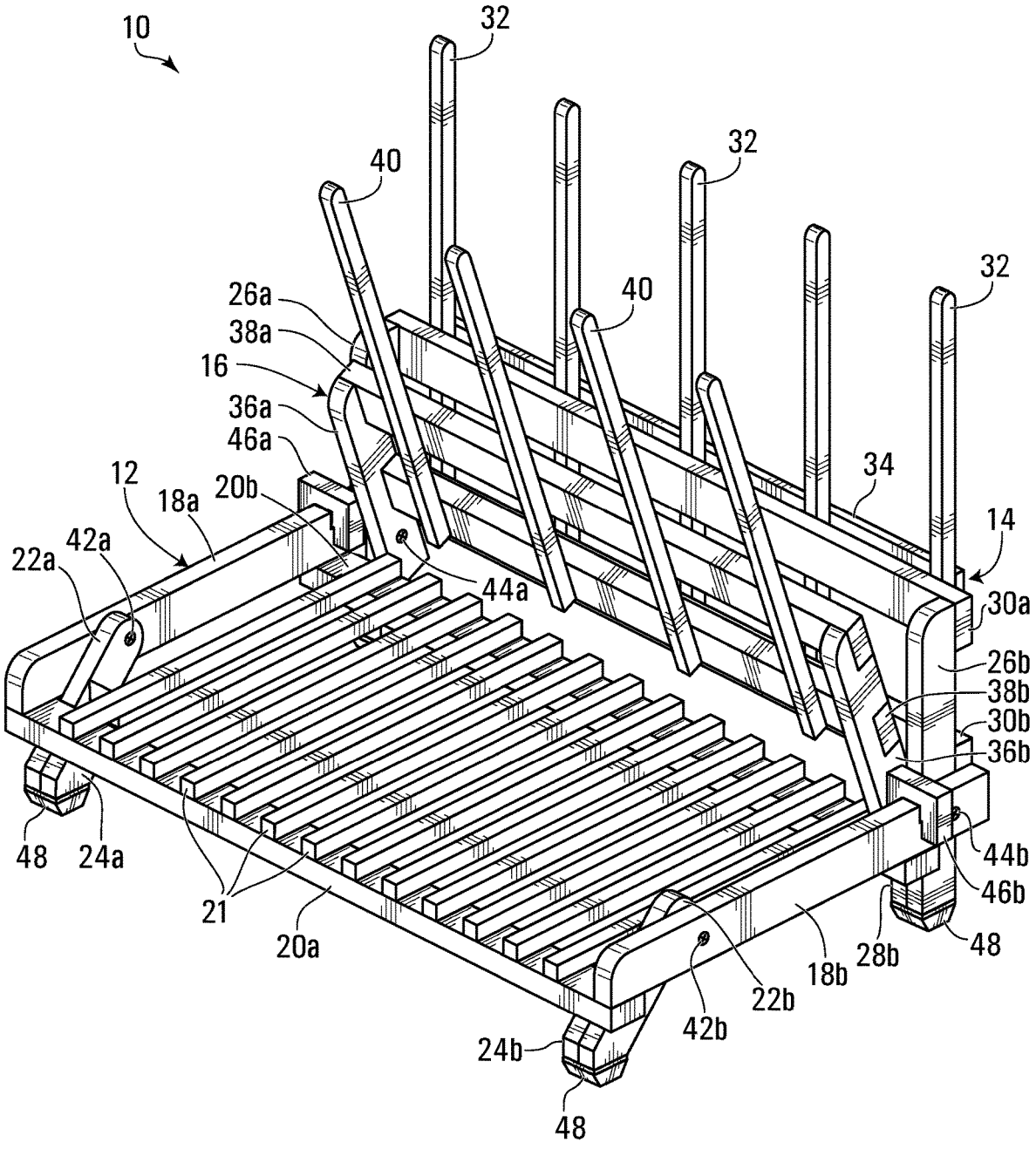
FIG. 1 is a perspective view of a foldable kitchenware drying rack in accordance with the invention, shown in an unfolded condition.

FIG. 1 is a perspective view of the foldable kitchenware drying rack 10 shown in an unfolded condition. In one embodiment the kitchenware drying rack 10 is made of bamboo, though any suitable renewable, stain-resistant wood species such as maple, oak, basswood, or the like may be used. All fasteners used to assemble the kitchenware drying rack 10 are made from a corrosion resistant metal such as stainless steel, and all adhesives used during assembly of the kitchenware drying rack 10 are non-toxic and waterproof when cured. In one embodiment a food-grade wood finish is applied to provide a protective and preservative finish on the assembled kitchenware drying rack 10.

The kitchenware drying rack 10 has a base section 12, a primary support section 14 and a secondary support section 16. In one embodiment, the base section 12 is substantially rectangular and has a dimension of about 360 mm×228 mm (14.17"×9"). In one embodiment, the base section 12 includes two base side members 18*a*, 18*b* of equal length. The two base side members 18*a*, 18*b* are affixed to top surfaces of opposed ends of parallel, spaced-apart base cross members 20*a*, 20*b*. Affixed to a top surface of each base cross member 20*a*-20*b* between the base side members 18*a*, 18*b* are a plurality of spaced-apart base slats 21 that are respectively parallel with the base side members 18*a*, 18*b*. The outermost base slats 21 are spaced from the respective base side members 18*a*, 18*b* far enough to accommodate pivoting front leg members 22*a*, 22*b*, pivoting rear leg members 26*a*, 26*b* and secondary side members 36*a*, 36*b* in a folded condition shown in FIG. 8. The base slats 21 between the two outermost base slats 21 are preferably equally spaced-apart. In one embodiment, the base slats 21 are substantially square and measure about 8 mm (0.315") per side. Top ends of the respective pivoting front leg members 22*a*, 22*b* are affixed to the respective base side members 18*a*, 18*b* by front leg pivots 42*a*, 42*b*. In one embodiment, a front leg foot member 24*a*, 24*b* is laminated to an inner side of the respective pivoting front leg members 22*a*, 22*b* to provide improved stability to the kitchenware drying rack 10.

The primary support section 14 is substantially rectangular and includes the two parallel pivoting rear leg members 26*a*, 26*b* of equal length. The pivoting rear leg members 26*a*, 26*b* are connected to the base side members 18*a*, 18*b* by primary/secondary section pivots 44*a*, 44*b*. In one embodiment, primary cross members 30*a*, 30*b* are affixed to a rear edge of the respective pivoting rear leg members 26*a*, 26*b*. The respective pivoting rear leg members 26*a*, 26*b* are pivotally connected to the base side members 18*a*, 18*b* by the primary/secondary section pivots 44*a*, 44*b* at a point that supports the base section 12 parallel to a supporting surface in an unfolded condition (see FIGS. 4 and 5). In one embodiment, a rear leg foot member 28*a*, 28*b* (better seen in FIG. 3) is laminated to an inner side of each pivoting rear leg member 26*a*, 26*b* to provide improved stability to the folding kitchenware drying rack 10 in the unfolded condition. The primary support section 14 further includes a plurality of equally spaced-apart primary support posts 32 affixed to a rear surface of the respective primary cross members 30*a*, 30*b*. In one embodiment there are 5 primary support posts 32, and the respective primary support posts 32 are 200 mm (7.87") in length and 8 mm×8 mm (0.315"×0.315") in cross-section. Primary support reinforcement member 34 is affixed to the outside surface of the primary support posts 32 and thereby provide additional structural support to primary support posts 32 (see FIGS. 3, 6, and 7).

Figure 8:
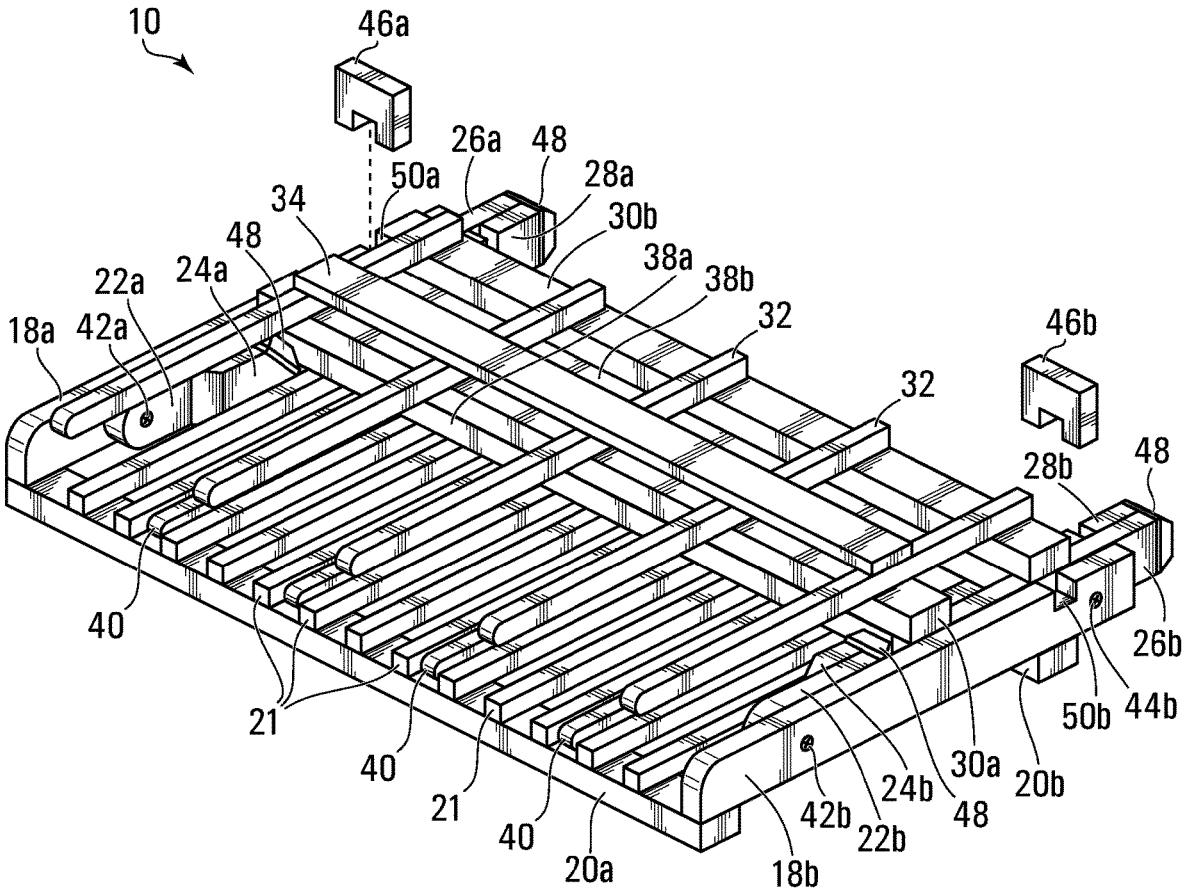
FIG. 8 is a perspective view of the kitchenware drying rack in a folded condition.

The secondary support section 16 includes two secondary side members 36*a*, 36*b* of equal length. The respective secondary side members 36*a*, 36*b* are pivotally connected at a bottom end thereof to an inner surface of the respective pivoting rear leg members 26*a*, 26*b* by the primary/secondary section pivots 44*a*, 44*b*. In one embodiment, the respective secondary side members 36*a*, 36*b* are affixed to front surfaces of two secondary cross members 38*a*, 38*b*. In one embodiment, each secondary cross member 38*a*, 38*b* is received in a rabbet cut into the respective secondary side members 36*a*, 36*b*. A plurality of secondary support posts 40 are affixed to a front surface of the respective secondary cross members 38*a*, 38*b*. In one embodiment, the secondary support section 16 includes 4 secondary support posts 40 with the same nominal dimensions as those the primary support posts 32. The respective secondary support posts 40 are respectively arranged to interleave pairs of the base slats 21 in the folded condition, as seen in FIG. 8. Affixed to a bottom surface of each pivoting front leg 22*a*,*b* and front foot member 24*a*,*b* and each pivoting rear leg 26*a*,*b* and rear foot member 28*a*,*b* is an elastomeric foot 48 which provides slip resistance and raises the wood portions of the drying rack 10 above wet surfaces in the unfolded condition, thereby significantly reducing the potential for mold on the wood surfaces. In one embodiment the respective elastomeric feet 48 are 20 mm×20 mm (0.79"×0.79") at the point of attachment.

In the unfolded condition, the pivoting front leg members 22*a*, 22*b* rest against a rear bottom edge of the base cross member 20*a* in a stable geometry as will be explained in more detail with reference to FIG. 4, and the pivoting rear leg members are locked against a rear side edge of the base cross member 20*b* by respective rectangular rear leg lock members 46*a*, 46*b* having an inverted U-shape that are received in rear leg lock rabbets 50*a*, 50*b* (see FIG. 8) cut into a top surface of the respective base side members 18*a*, 18*b* in a location adjacent a front edge of the pivoting rear leg members 26*a*, 26*b* in the unfolded condition. In the unfolded condition, the secondary side members 36*a*, 36*b* of the secondary support section 16 rest against a lower front corner of the lower primary cross member 30*b* in a stable condition best seen in FIGS. -6.

Figure 2:
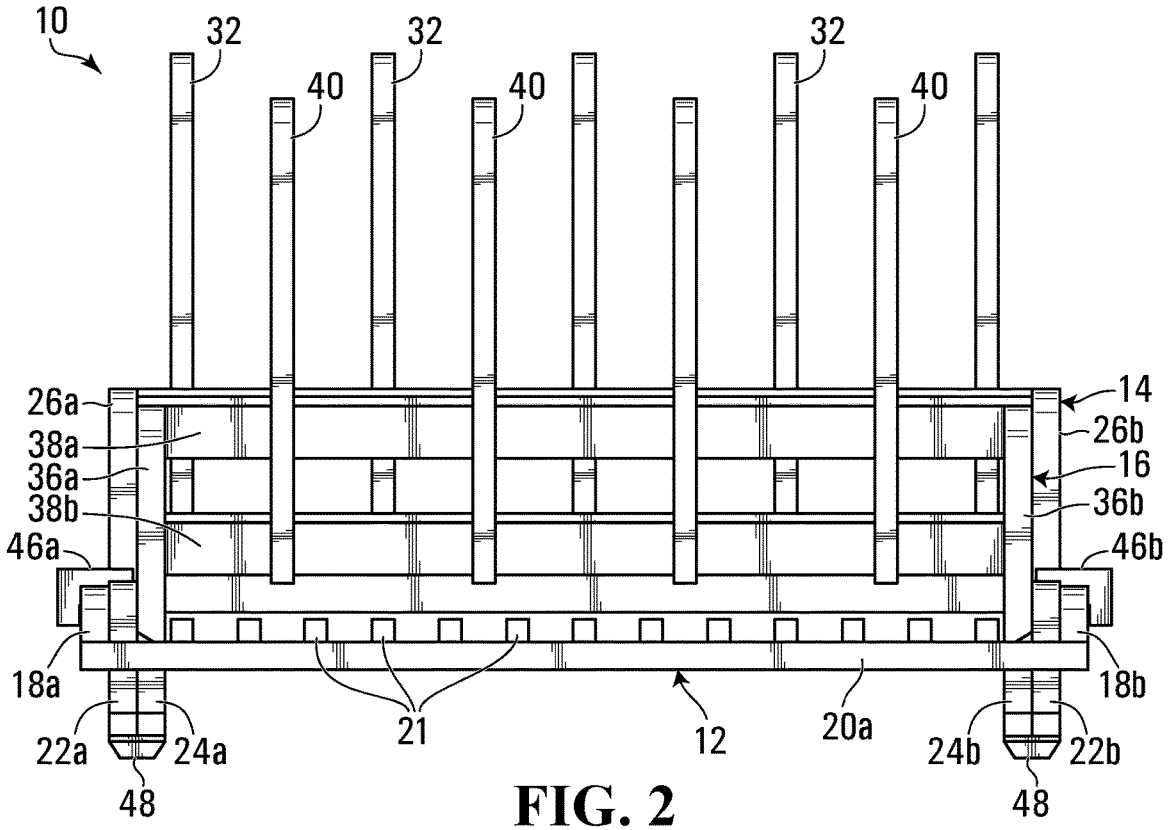
FIG. 2 is a front elevational view of the kitchenware drying rack in the unfolded condition.

FIG. 2 is a front elevational view of the foldable kitchenware drying rack 10 in the unfolded condition. As explained above, the outermost base slats 21 are spaced from the respective base side members 18*a*, 18*b* enough to accommodate the pivoting front leg members 22*a*, 22*b* with front leg foot members 24*a*, 24*b*, the pivoting rear leg members 26*a*, 26*b* and secondary side members 36*a*, 36*b*. In one embodiment, the space between the outermost base slats 21 and the respective base side members 18*a*, 18*b* is about 33% greater than the space between the other equally spaced apart base slats 21.

Figure 3:
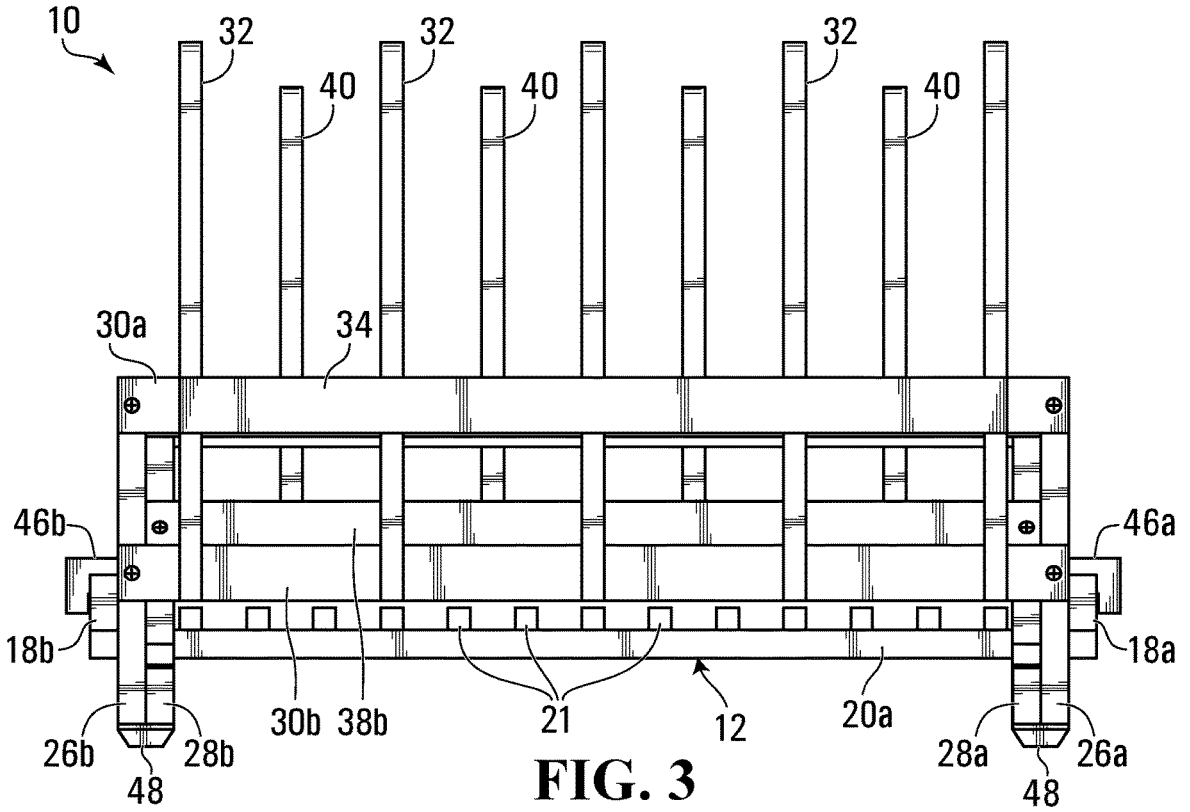
FIG. 3 is a rear elevational view of the kitchenware drying rack in the unfolded condition.

FIG. 3 is a rear elevational view of the kitchenware drying rack 10 in the unfolded condition. In one embodiment the primary support section 14 includes a primary support reinforcement member 34 that is aligned with the primary cross member 30*a* and is affixed to each primary support post 32. The primary support reinforcement member 34 extends from an outer edge of the respective outermost primary support posts 32 on each side of the primary support section 14, as also seen in FIGS. 6 and 7.

Figure 4:
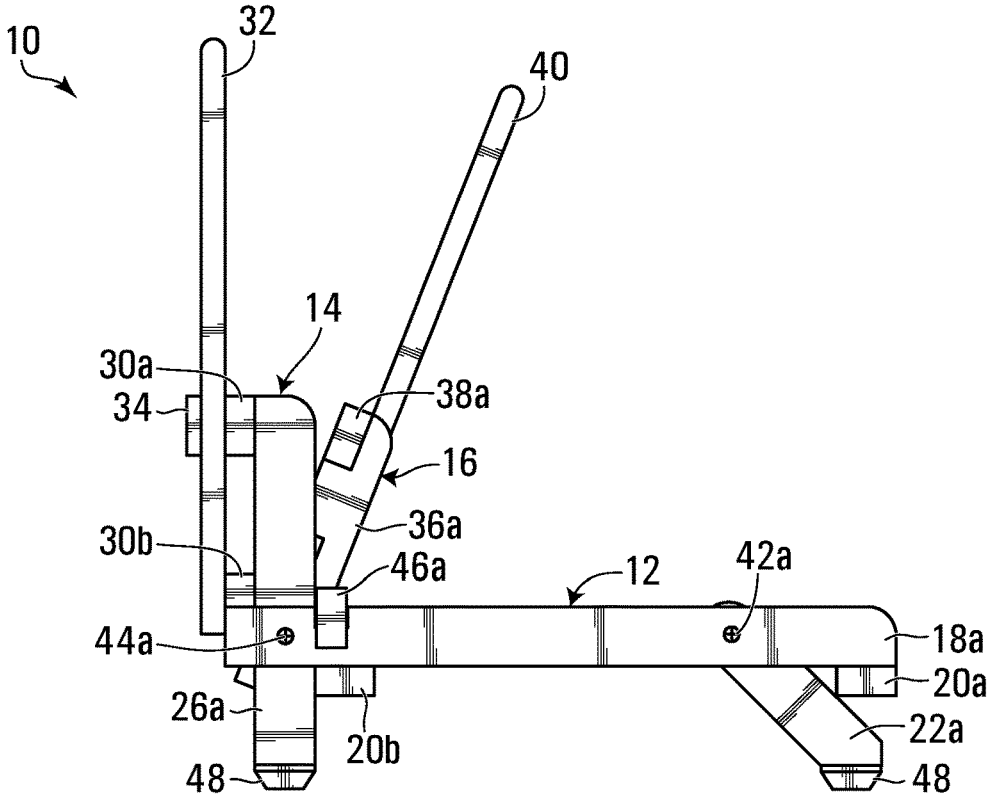
FIG. 4 is a right side elevational view of the kitchenware drying rack in the unfolded condition.
Figure 5:
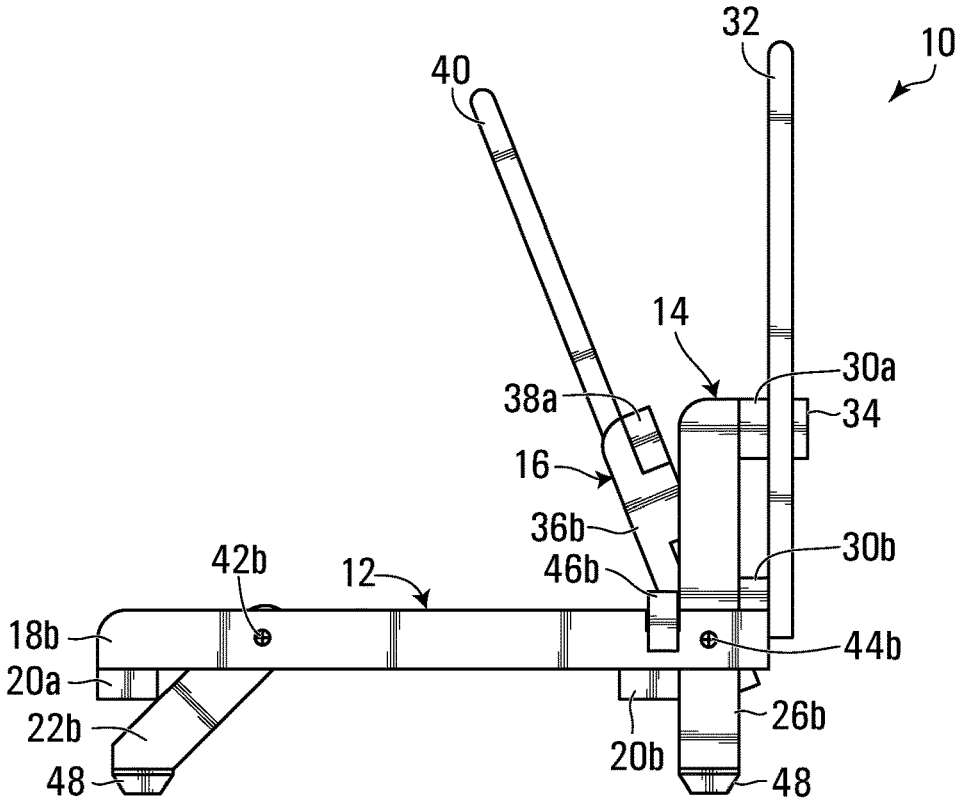
FIG. 5 is a left side elevational view of the kitchenware drying rack in the unfolded condition.

FIG. 4 is a left side elevational view and FIG. 5 is a right side elevational view of the kitchenware drying rack 10 in the unfolded condition. Each pivoting rear leg member 26*a*, 26*b* and each secondary side member 36*a*, 36*b* has rounded front top corner. As explained above, the front edge of the bottom ends of the respective pivoting rear leg members 26*a*, 26*b* rest against the base cross member 20*b* in the unfolded condition, and the rear leg lock members 46*a*, 46*b* lock the primary support section 14 in the unfolded condition. In the unfolded condition the top edge of the respective pivoting front leg members 22*a*, 22*b* rests against the base cross member 20*a*, and each pivoting front leg member 22*a*, 22*b* is supported at an angle of about 45° with respect to a flat supporting surface. In the unfolded condition the secondary side members 36*a*, 36*b* of the secondary support section 16 rest against a lower front corner of the lower primary cross member 30*b* of the primary support section 14 in a stable condition.

Figure 6:
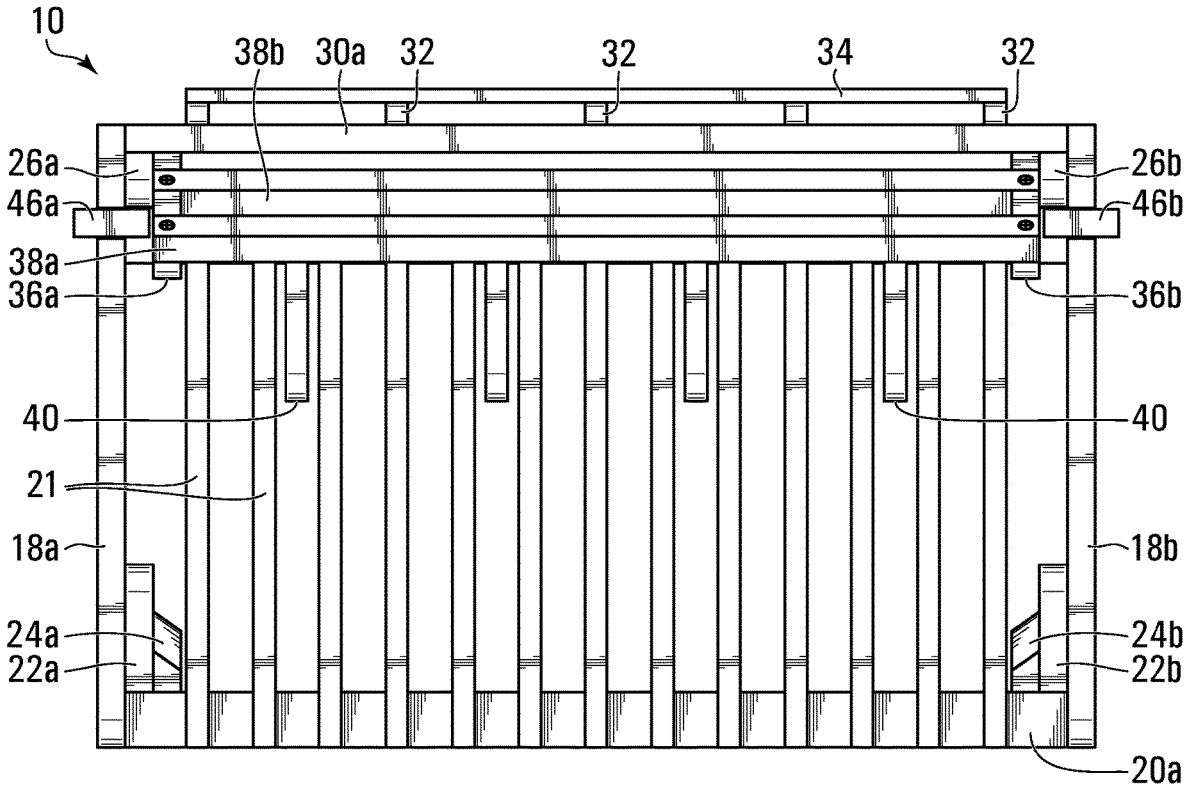
FIG. 6 is a top plan view the of the kitchenware drying rack in the unfolded condition.
Figure 7:
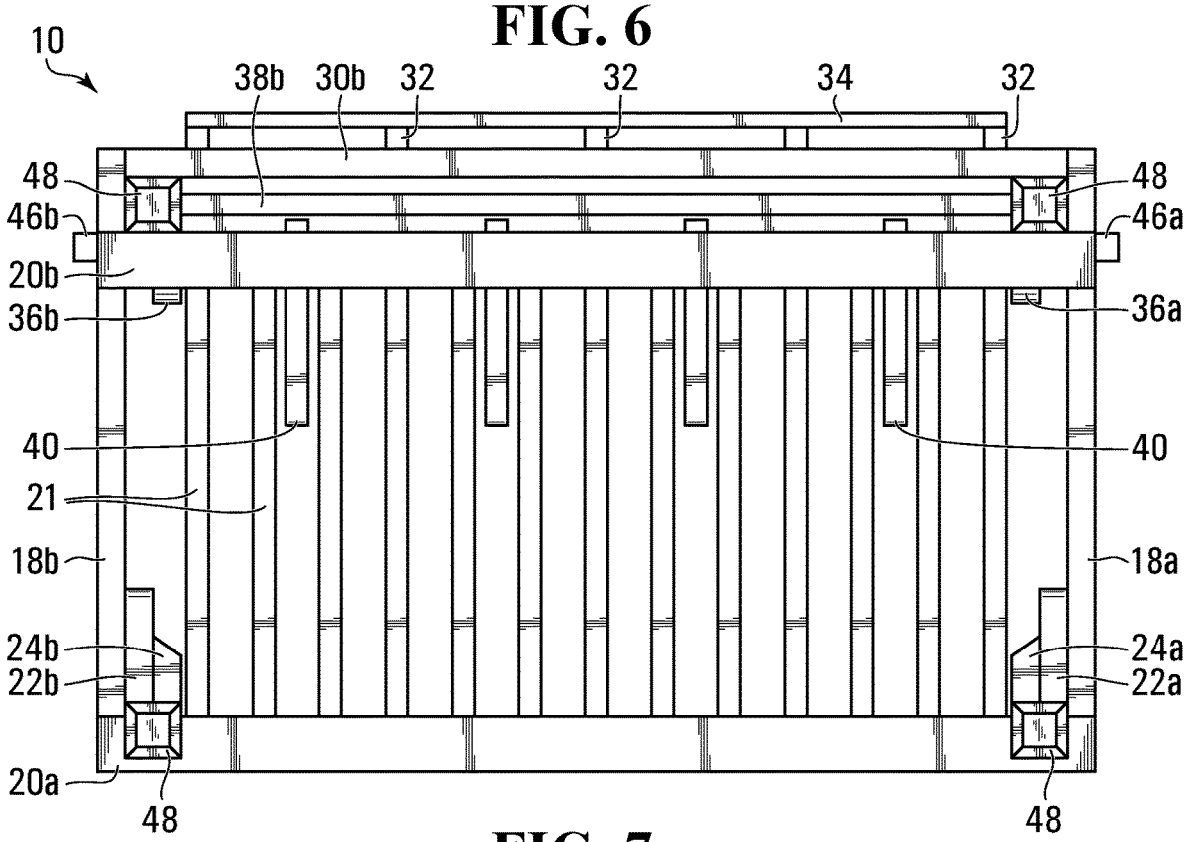
FIG. 7 is a bottom plan view of the kitchenware drying rack in the unfolded condition.

FIG. 6 is a top plan view and FIG. 7 is a bottom plan view of the kitchenware drying rack 10 in the unfolded condition. As explained above, in one embodiment the secondary support posts 40 are equally spaced between the primary support posts 32 and corresponding base slats 21.

FIG. 8 is a perspective view of the kitchenware drying rack 10 in a folded condition. To collapse the kitchenware drying rack 10 to the folded condition, the pivoting front leg members 22*a*, 22*b* are rotated rearwardly until they align with the base side members 18*a*, 18*b*. The rear leg lock members 46*a*, 46*b* are removed from rear leg lock rabbets 50*a*, 50*b* and the primary support section 14 is rotated forwardly with the secondary support section 16 until the secondary support posts 40 rest against the base cross members 20*a* and 20*b*. These two folding steps can be performed in an opposite order. In the folded condition, the kitchenware drying rack 10 is a compact rectangle to minimize occupied storage space.

Figure 9:
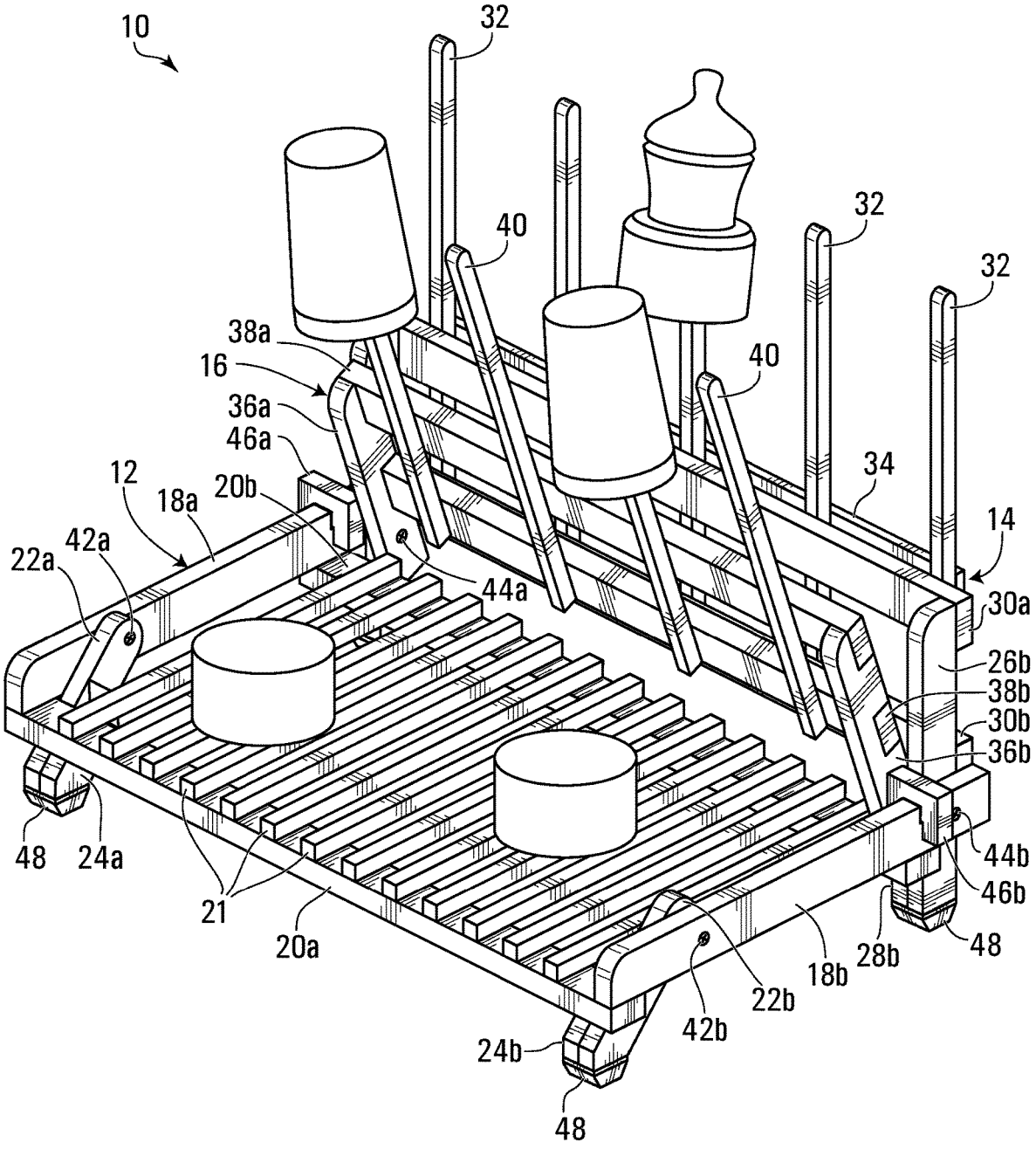
FIG. 9 is perspective view of the kitchenware drying rack in an exemplary use condition.

FIG. 9 is a perspective view of the kitchenware drying rack 10 in an exemplary use condition. Bottles, plastic bags, cups or any items which are best air dried in an inverted or suspended condition are supported on the primary support posts 32 and/or the secondary support posts 40. Very heavy items and items that rest stably on a flat surface can be placed on the base slats 21. The pivoting front leg members 22*a*, 22*b* and the pivoting rear leg members 26*a*, 26*b* support the base section 12 well above a supporting surface to ensure optimal air circulation. The elastomeric feet 48 protect the respective pivoting front leg members 22*a-b* and pivoting rear leg members 26*a-b* from any water that drips onto a surface supporting the kitchenware drying rack 10 or onto a drying mat placed under the drying rack 10.

The embodiment of the invention shown and described is exemplary only. The scope of the invention is therefore intended to be limited only by the scope of the claims.

I claim:

1. A foldable kitchenware drying rack comprising:

a substantially rectangular base section having base side members, at least two base cross members and a plurality of base slats connected to the respective base cross members;

first and second pivoting front leg members affixed by front leg pivots to an inner side of each base side member at a location spaced from a front end of the respective base side members;

first and second pivoting rear leg members affixed to an inner side of the base side members at a location near a rear end of each base side member;

at least two primary cross members connected on opposed ends to the first and second pivoting rear leg members;

primary support posts connected to the respective primary cross members in a spaced-apart relationship in parallel with the first and second pivoting rear leg members;

first and second secondary side members pivotally connected on a bottom end to and inner side of the respective pivoting rear leg members;

at least two secondary cross members connected on opposed ends to the respective first and second secondary side members;

secondary support posts affixed to the respective secondary cross members in parallel with the first and second secondary side members;

and lock members for locking the first and second pivoting rear leg members in an unfolded condition.

2. The foldable kitchenware drying rack as claimed in claim 1 wherein a front one of the base cross members is flush with front ends of the respective base side members and a rear one of the base cross members is spaced forward of a rear end of the respective base side members.

3. The foldable kitchenware drying rack as claimed in claim 1 wherein the at least two primary cross members comprise a first primary cross member and a second primary cross member affixed in spaced-apart relation to a rear edge of the respective pivoting rear leg members, and the primary support posts are affixed in a spaced-apart relationship to a rear surface of the first and second primary cross members in parallel with the respective pivoting rear leg members.

4. The foldable kitchenware drying rack as claimed in claim 1 wherein the least two secondary cross members comprise a first secondary cross member and a second secondary cross member connected to an inner surface of the respective secondary side members.

5. The foldable kitchenware drying rack as claimed in claim 4 wherein the first and second secondary cross members are respectively received in rabbets cut in the rear surface of the first and second secondary side members.

6. The foldable kitchenware drying rack as claimed in claim 1 wherein the pivoting rear leg members and the secondary side members on each side of the foldable drying rack respectively pivot on the same a primary/secondary section pivot connected to a respective one of the base side members on a corresponding side of the foldable bottle drying rack.

7. The foldable kitchenware drying rack as claimed in claim 1 wherein the pivoting front leg members and the pivoting rear leg members respectively comprise a foot member that increases a width of the respective pivoting front leg members and rear leg members where they contact a supporting surface.

8. The foldable kitchenware drying rack as claimed in claim 1 further comprising a base foot affixed to a bottom end of each of the pivoting front leg members and each of the pivoting rear leg members.

9. The foldable kitchenware drying rack as claimed in claim 8 wherein the base foot is elastomeric.

10. The foldable kitchenware drying rack as claimed in claim 1 wherein the lock members comprise inverted U-shaped rectangles received in rear leg lock rabbets cut in a top surface of the first and second base side members.

11. The foldable kitchenware drying rack as claimed in claim 1 further comprising a primary support reinforcement member affixed to a rear side of the primary support posts opposite a top one of the primary cross members.

12. The foldable kitchenware drying rack as claimed in claim 1 wherein outermost ones of the base slats are spaced inwardly from the respective base side members to accommodate the pivoting front leg members, the pivoting rear leg members, and the secondary side members in a folded condition.

13. The foldable kitchenware drying rack as claimed in claim 12 wherein all other base slats are equally spaced-apart between the outermost ones of the base slats.

14. A foldable kitchenware drying rack comprising:

a base section having first and second parallel base side members affixed to at least two base cross members and a plurality of identical base slats in a spaced-apart parallel relation between the base side members and affixed to the base cross members;

a primary support section having first and second parallel pivoting rear leg members, each pivoting rear leg member pivotally connected above a bottom end to one of the first and second base side members behind a rear one of the base cross members, at least two primary cross members respectively connected on opposed ends to the first and the second pivoting rear leg members, and a plurality of primary support posts affixed to the primary cross members between the pivoting rear leg members and parallel therewith;

a secondary support section having first and second secondary side members, each secondary side member being connected on a bottom end to an inner surface above the bottom end of one of the first and second pivoting rear leg members, and at least two secondary cross members having opposed ends respectively connected to the secondary side members, and a plurality of secondary support posts affixed to the first and second secondary cross members in parallel with the first and second secondary side members; and rear leg lock members that lock the pivoting rear leg members in an unfolded condition.

15. The foldable kitchenware drying rack as claimed in claim 14 further comprising pivoting front leg members, and the pivoting front leg members have front leg foot members laminated to an inside surface of their bottom ends, and the pivoting rear leg members have rear leg foot members laminated to an inside surface of their bottom ends.

16. The foldable kitchenware drying rack as claimed in claim 15 wherein the pivoting front leg members with the front leg foot members and the pivoting rear leg members with the rear leg foot members are each provided with an elastomeric foot affixed to a bottom surface thereof.

17. The foldable kitchenware drying rack as claimed in claim 14 wherein the rear leg lock members are rectangular blocks having an inverted U-shape.

18. The foldable kitchenware drying rack as claimed in claim 17 wherein the rear leg lock members are received in rabbits cut in the respective base side members at a front edge of the pivoting rear leg members in the unfolded condition.

19. The foldable kitchenware drying rack as claimed in claim 14 further comprising a primary support reinforcement member connected to a rear side of the primary support posts in alignment with a top one of the primary cross members.

20. The foldable kitchenware drying rack as claimed in claim 19 wherein the primary support reinforcement member extends from an outer edge of an outermost one of the primary support posts to an outer edge of the other outermost one of the primary support posts.

* * * * *